US010371477B1

(12) United States Patent
Dobson, Jr.

(10) Patent No.: US 10,371,477 B1
(45) Date of Patent: Aug. 6, 2019

(54) CHOKE ASSEMBLY FOR SHOTGUN

(71) Applicant: Terry Dobson, Jr., Stephenville, TX (US)

(72) Inventor: Terry Dobson, Jr., Stephenville, TX (US)

( * ) Notice: Subject to any disclaimer, the term of this patent is extended or adjusted under 35 U.S.C. 154(b) by 0 days.

(21) Appl. No.: 16/007,331

(22) Filed: Jun. 13, 2018

(51) Int. Cl.
*F41A 21/40* (2006.01)

(52) U.S. Cl.
CPC ..... *F41A 21/40* (2013.01)

(58) Field of Classification Search
CPC ..... F41A 21/40; F41A 21/42
USPC ..... 42/79
See application file for complete search history.

(56) References Cited

U.S. PATENT DOCUMENTS 555,432 A 2/1896 Cory
906,443 A 12/1908 Michaud
918,784 A 4/1909 Snow
2,092,649 A * 9/1937 Jung ..... F41A 21/40 42/79
2,476,438 A 7/1949 Wright
2,629,958 A * 2/1953 Roper ..... F41A 21/42 42/79
2,888,769 A * 6/1959 Grahn ..... F41A 21/40 42/79
3,089,273 A 5/1963 Philippe
3,698,747 A 10/1972 Wing et al.
4,951,409 A * 8/1990 Froid ..... B25B 13/48 42/90
5,685,102 A 11/1997 Latka
5,706,599 A 1/1998 Knight
6,273,080 B1 8/2001 Sullivan, Jr.
6,655,372 B1 12/2003 Field et al.

* cited by examiner

*Primary Examiner* — Stephen Johnson
(74) *Attorney, Agent, or Firm* — Bushman Werner, P.C.

(57) ABSTRACT

A choke assembly for use with a shotgun, the choke assembly having a collar attachable to the muzzle of the shotgun. There is a sleeve attached to the collar, the sleeve having at least one tapered bore or aperture, a ball being received in the aperture. There is a tubular slide in surrounding relationship to the sleeve and the collar, there being annular radially outwardly and radially inwardly facing recesses on the slide and collar, respectively, which cooperate to form an annular spring pocket. There is a compression spring received in the pocket, the ball having a portion extending through the tapered bore and a threadless choke received in the sleeve, the choke having an indentation in which at least a portion of the ball is received when the choke is inserted into the sleeve.

9 Claims, 3 Drawing Sheets

CHOKE ASSEMBLY FOR SHOTGUN

FIELD OF THE INVENTION

The present invention relates to choke assemblies for use with shotguns.

BACKGROUND OF THE INVENTION

Chokes are commonly used with shotguns to alter the pattern of the shot when the shotgun is fired. Basically a choke is a tubular member formed in or attachable to the muzzle end of the barrel of a shotgun and forms a tapered constriction of the gun's barrel bore at the muzzle end. Accordingly, the exit end of the choke has a smaller inside diameter (ID) by some amount than the ID of the gun barrel. Chokes, tighten the shot pattern and enable the shooter to shoot further distances with this tight pattern of shot.

The prior art discloses choke assemblies which can be constructed so as to be selectively attached to and removed from the gun barrel or which may be constructed and manufactured as part of the gun barrel.

SUMMARY OF THE INVENTION

In one aspect, the present invention relates to a choke assembly for a shotgun which can be fixedly attached to the shotgun.

In another aspect, the present invention relates to a choke assembly which can be selectively attached to or removed from a shotgun.

In a further aspect, the present invention relates to a threadless choke for use with a shotgun.

These and further features and advantages of the present invention will become apparent from the following detailed description, wherein reference is made to the figures in the accompanying drawings.

DETAILED DESCRIPTION OF PREFERRED EMBODIMENTS

Figure 1:
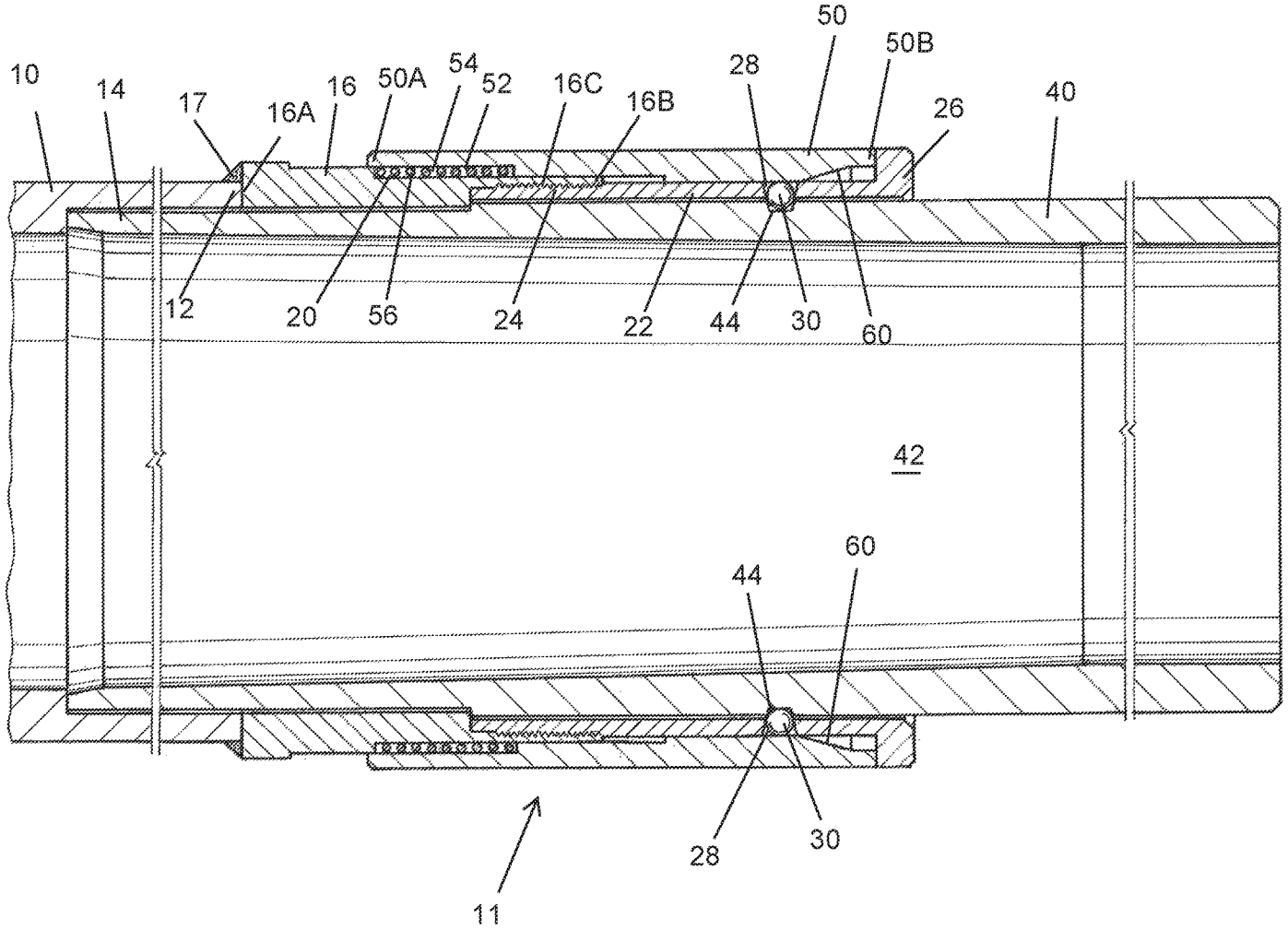
FIG. 1 is a side, elevational view, partly in section, showing one embodiment of the choke assembly of the present invention in the locked position.
Figure 2:
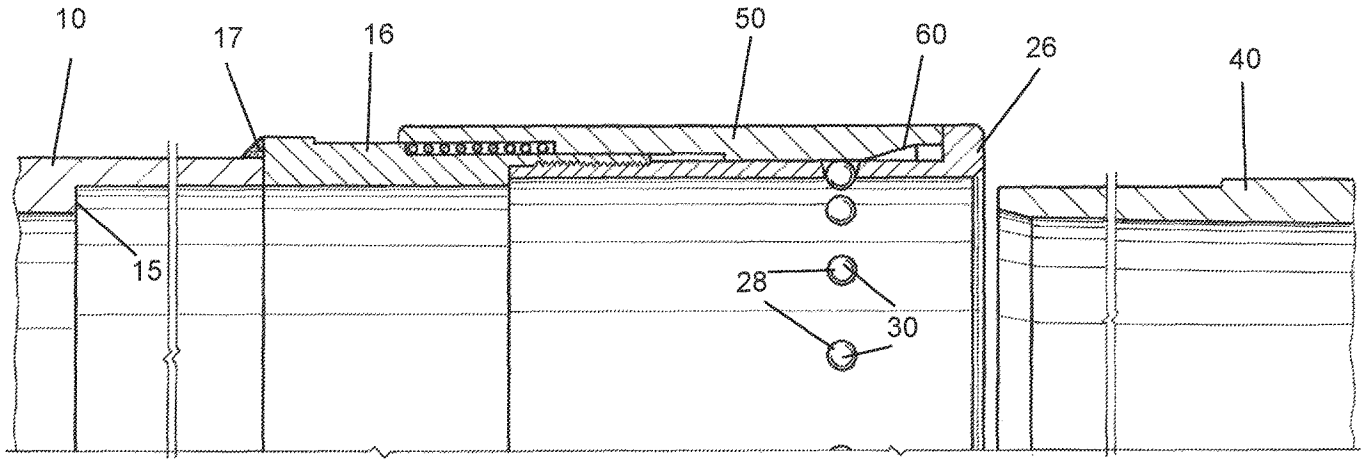
FIG. 2 is a view similar to FIG. 1, showing the choke assembly of FIG. 1 with the choke removed.
Figure 3:
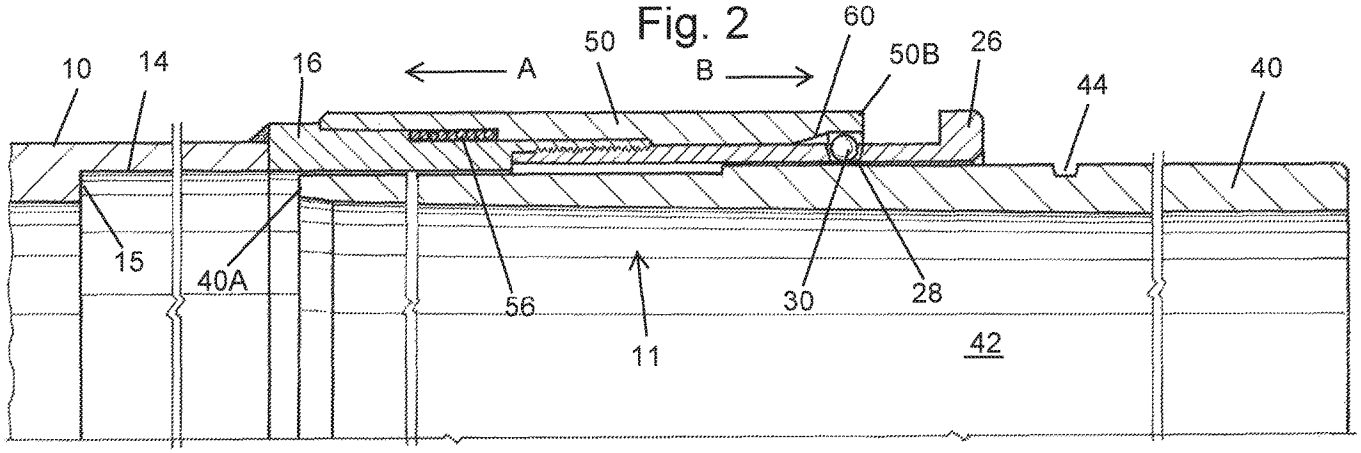
FIG. 3 is a view similar to FIG. 2, showing the choke assembly of FIG. 1 in the unlocked position.

Referring first to FIGS. 1-3, there is shown a portion of a shotgun barrel 10 having a muzzle 12 attached to a choke assembly, shown generally as 11. Shotgun barrel 10 has a counterbore 14 formed in muzzle 12. Connected to muzzle 12 of shotgun barrel 10 is a collar 16, the first end 16A of collar 16 being welded as at 17 to muzzle 12 of shotgun barrel 10. Collar 16 has a second end 16B forming a reduced diameter portion which is internally threaded. Collar 16 also has a radially outwardly facing, annular recess 20 proximal first end 16A for a purpose hereafter described. An annular sleeve 22 has an externally threaded portion 24 which is threadedly received on internal threads 16C on collar 16. Sleeve 22 terminates in an annular, radially outwardly projecting flange 26. Further, sleeve 22 is provided with a series of circumferentially spaced tapered apertures 28 in which are nested balls 30. It should be noted that in the embodiment shown in FIG. 1, the choke assembly 11 is in the locked position, i.e., it is connected to shotgun barrel 10 and ready for use.

A choke 40 having a tapered bore 42 and a radially outwardly facing annular groove 44 is shown in FIG. 1 as being received in the choke assembly 11, whereby a first end of the choke 40 is received in the counterbore 14 of shotgun barrel 10. In this fully engaged or locked position, balls 30 engage groove 44 preventing choke 40 from being removed or ejected from the choke assembly 11.

There is a tubular slide 50 having a first end 50A and a second end 50B in surrounding relationship to sleeve 22, an inner wall surface of slide 50 engaging balls 30 and forcing balls 30 at least partially through tapered apertures 28 into groove 44. Slide 50 on end 50A has an internal, radially inwardly facing recess 52. As can be seen in FIG. 1, recess 52 and recess 20 cooperate to form an annular spring pocket 54 in which is received a compression spring 56. Spring 56 serves to bias second end 50B of slide 50 against flange 26. Slide 50 also includes an internal, annular camming surface 60 for reasons hereafter described.

Turning now to FIG. 2, the shotgun/choke assembly is shown with the choke 40 removed. It will be appreciated that in the position shown in FIG. 2, choke 40 cannot be inserted into the choke assembly 11 since the balls 30 are forced radially inwardly of the grooves 28 stopping choke 40 from moving to the fully engaged or locked position.

In order to fully insert choke 40, and as shown in FIG. 3, slide 50 is now moved in the direction of arrow A compressing spring 56. This movement also allows camming surface 60 to move in register with balls 30 allowing balls 30 to move radially of apertures 28 inwardly into groove 44. At this point, slide 50 is allowed to move under the force of the spring 56 in the direction of arrow B at which point balls 30 engage groove 44 and lock choke 40 in choke assembly 11.

Figure 4:
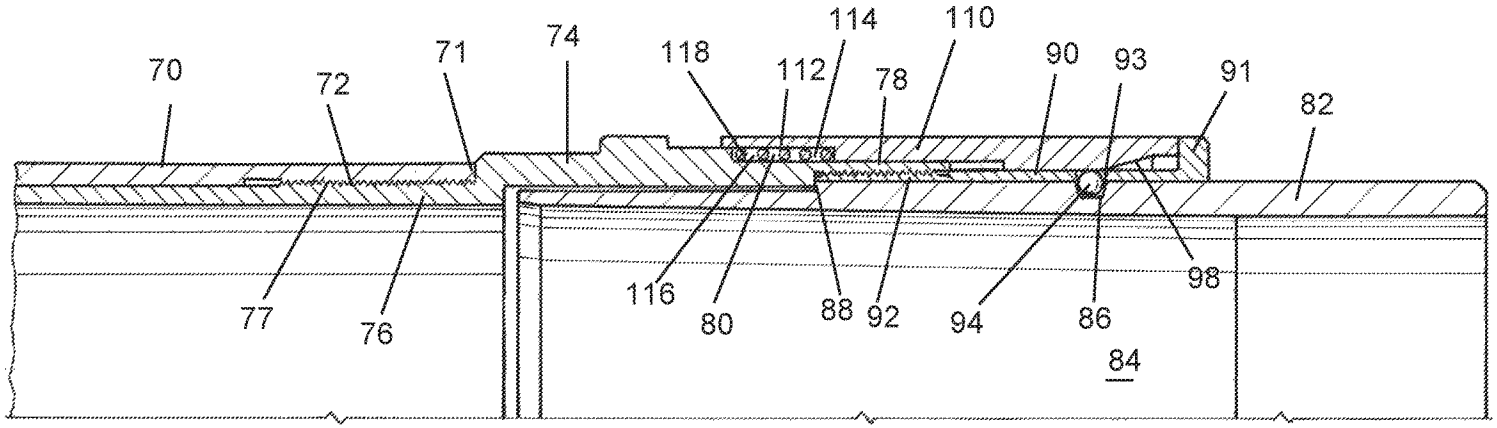
FIG. 4 is a side, elevational view, showing another embodiment of the choke assembly of the present invention in the locked position.

Referring now to FIG. 4, there is shown another embodiment of the choke assembly of the present invention. Shotgun barrel 70 having a muzzle 71 is internally threaded as at 72. There is an annular collar 74 having an axially extending, reduced diameter portion 76 which is externally threaded as at 77 to threadedly engage threads 72 of barrel 70. Collar 74 also has a second axially extending reduced diameter portion 78 which forms an annular, radially outwardly facing recess 80. A choke 82 having a tapered bore 84 and a radially outwardly facing, axially extending groove 86 is received in the choke assembly, choke 82 having an external, axially facing annular shoulder 88. There is a sleeve 90 having a threaded portion 92 threadedly engageable with threaded portion 78 of collar 74. Sleeve 90 which terminates in an annular, radially outwardly extending flange 91 has a plurality of circumferentially spaced, radially extending bores 93 in which are received respective ones of balls 94, e.g., ball bearings. Formed internally of sleeve 90 adjacent flange 91 is an annularly extending camming surface 98, the purpose of which is hereafter described.

In generally surrounding relationship to sleeve 90 is a tubular slide 110, tubular slide 110 having a reduced diameter portion 112 forming an annular, radially inwardly facing recess 114, recesses 114 and 80 cooperating to form an annular pocket 116 in which is received a compression spring 118. The operation of the embodiment of FIG. 4 is similar to that described for FIGS. 1-3. It is to be noted however that unlike the embodiment of FIGS. 1-3, the innermost end of choke 82 does not extend into the barrel 70 of the shotgun.

Figure 5:
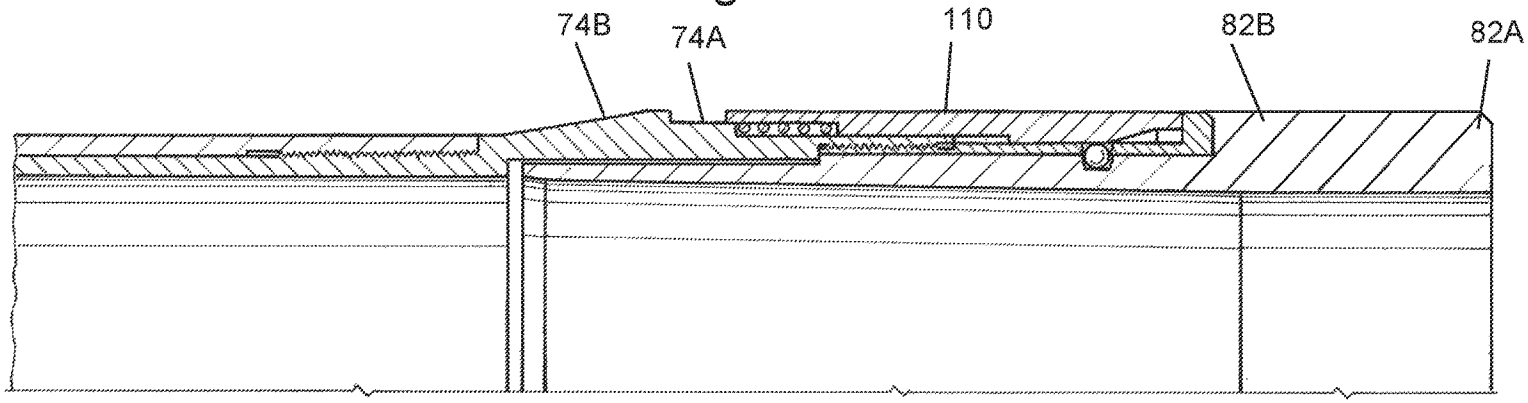
FIG. 5 is a side, elevational view, showing another embodiment of the choke assembly of the present invention in the locked position.

Turning now to FIG. 5, there is shown a slightly different embodiment than that depicted in FIG. 4. The embodiment shown in FIG. 5 differs from that shown in FIG. 4 in that choke 82A includes an enlarged end portion 82B which as seen makes the outer surface of the choke 82A which extends out of the choke assembly generally flush with the slide 110, i.e. the outside diameter (OD) of end portion 82A is substantially the same as the OD of slide 110. Additionally, collar 74A has an annularly extending chamfered surface 74B, chamfered surface 74B and enlarged end portion 82B of choke 82A serving to make a more sleek appearance for this embodiment of the choke assembly of the present invention.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A choke assembly for attachment to the muzzle of a shotgun, comprising:

a collar having a first collar end and a second collar end, said first collar end being adapted to be connected to the muzzle of a shotgun, said collar having an annular outwardly-facing recess and an internally threaded portion proximal said second collar end;

a sleeve having a first sleeve end and a second sleeve end, said sleeve being externally threaded proximal said first sleeve end and threadably connectable to said threaded portion of said collar, said sleeve including at least one tapered bore and an annular radially outwardly extending flange on said second sleeve end;

a tubular slide in surrounding relationship to at least a portion of said sleeve and said collar, said tubular slide having a first slide end having an annular radially inwardly facing recess, said inwardly facing recess and said outwardly facing recess cooperating to form an annular pocket;

a spring received in said annular pocket and biasing said tubular slide against said flange;

a ball received in said tapered bore and having a portion extending through said tapered bore;

a choke having a first choke end, a second choke end, and an external wall, said external wall having at least one indentation, said portion of said ball being received in said indentation when said choke is received in said sleeve, said choke being slidably received in said sleeve.

2. The choke assembly of claim 1, wherein said first collar end is welded to said muzzle of said shotgun.

3. The choke assembly of claim 2, wherein said choke has a portion extending into the muzzle of said shotgun when said choke assembly is welded to said muzzle of said shotgun.

4. The choke assembly of claim 1, wherein there are a plurality of circumferentially displaced bores.

5. The choke assembly of claim 4, wherein said indentation on said choke comprises annular external groove, said groove being in register with said bores when said choke is received in said sleeve.

6. The choke assembly of claim 1, wherein there is an internal camming surface formed in said sleeve proximal said second slide end.

7. The choke assembly of claim 6, wherein when said slide is moved in a direction away from said flange against the force of said spring, said camming surface is moved into register with said tapered bore and said ball is free to disengage from said indentation on said external wall.

8. The choke assembly of claim 1, wherein said first collar end is threadedly connected to said muzzle of said shotgun.

9. The choke assembly of claim 1, wherein said choke has a longitudinally extending internal tapered bore.

* * * * *